US011261684B2

(12) United States Patent
Burky et al.

(10) Patent No.: US 11,261,684 B2
(45) Date of Patent: Mar. 1, 2022

(54) SYSTEMS AND METHODS FOR DOWNHOLE TUBULAR CUTTING

(71) Applicant: Halliburton Energy Services, Inc., Houston, TX (US)

(72) Inventors: Thomas Earl Burky, Mansfield, TX (US); Darren Phillip Walters, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/961,744

(22) PCT Filed: Apr. 6, 2018

(86) PCT No.: PCT/US2018/026589
§ 371 (c)(1),
(2) Date: Jul. 13, 2020

(87) PCT Pub. No.: WO2019/194838
PCT Pub. Date: Oct. 10, 2019

(65) Prior Publication Data

US 2021/0062601 A1 Mar. 4, 2021

(51) Int. Cl.
*E21B 29/02* (2006.01)
*E21B 37/00* (2006.01)

(52) U.S. Cl.
CPC ..... *E21B 29/02* (2013.01); *E21B 37/00* (2013.01)

(58) Field of Classification Search
CPC ..... E21B 29/00; E21B 29/02; E21B 31/002; E21B 31/16; E21B 23/04; E21B 23/0417
See application file for complete search history.

(56) References Cited

U.S. PATENT DOCUMENTS 2,839,142 A * 6/1958 Huber ..... E21B 33/1275 166/297
3,031,964 A * 5/1962 Chesnut ..... E21B 43/117 175/4.52
3,422,897 A * 1/1969 Conrad ..... E21B 33/1295 166/122
7,073,448 B2 7/2006 Bell
2002/0056553 A1 5/2002 Duhon et al.
2003/0111220 A1 6/2003 Bell
2004/0089450 A1 * 5/2004 Slade ..... E21B 41/0078 166/298

(Continued)

FOREIGN PATENT DOCUMENTS

EP 2282002 A2 2/2011

OTHER PUBLICATIONS

International Search Report and Written Opinion dated Oct. 26, 2018, International PCT Application No. PCT/US2018/026589.

(Continued)

*Primary Examiner* — David Carroll
(74) *Attorney, Agent, or Firm* — McGuireWoods LLP

(57) ABSTRACT

A downhole tubular cutting system includes a cutter comprising an explosive material configured to cut a tubular. The system further includes a generator body coupled to the cutter on an end of the cutter such that the generator body will be oriented uphole or downhole of the cutter when the cutter is positioned with the tubular. A detonating cord or igniter fuse is disposed around the generator body.

11 Claims, 13 Drawing Sheets

(56) References Cited

U.S. PATENT DOCUMENTS

| | | | | |
|---|---|---|---|---|
| 2005/0189141 | A1 | 9/2005 | Bell | |
| 2010/0132578 | A1 | 6/2010 | Yang et al. | |
| 2012/0138302 | A1* | 6/2012 | Stehle | E21B 43/116 166/297 |

OTHER PUBLICATIONS

European Supplementary Search Report dated Jun. 24, 2021; European Patent Application No. EP 18913322.

* cited by examiner

SYSTEMS AND METHODS FOR DOWNHOLE TUBULAR CUTTING

BACKGROUND

The present disclosure relates generally to downhole tubular cutters used within a well, and more specifically to systems and methods employing fluid displacement to improve the performance of the tubular cutter.

Downhole tubular cutters suffer from a lack of cutting efficiency, particularly as the distance between an outside diameter of the cutter and an inside diameter of the tubular increases. Wellbore fluid surrounding the cutter may be difficult to penetrate, especially when the well is deep or the pressure of the wellbore fluid is otherwise high. Such conditions require that cutters of increased size be used especially with large diameter tubulars. Having to obtain a cutter that is matched closely in size to the diameter of the tubular to be cut may be an impractical solution. Multiple sizes of cutters may need to be kept on hand in order to effectively cut the various sized tubulars that may be encountered in a single or multi-well project. Further, the efficiency of the cutter may still be affected by the presence of the adjacent wellbore fluid even when the cutter is sized appropriately.

DETAILED DESCRIPTION

Figure 1:
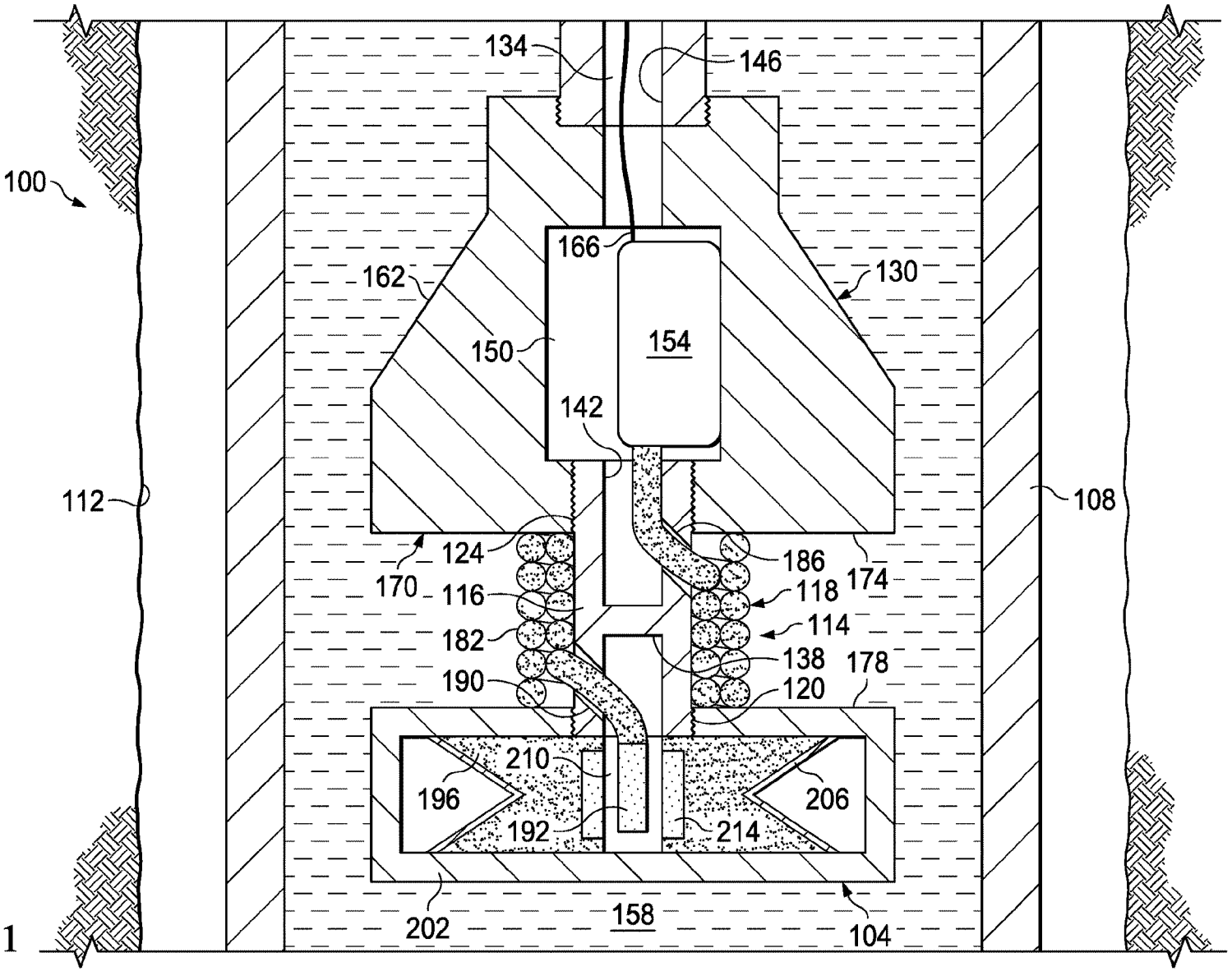
FIG. 1 illustrates a schematic view of a downhole tubular cutting system according to an illustrative embodiment, the cutting system being shown in a pre-initiation stage.

In the following detailed description of several illustrative embodiments, reference is made to the accompanying drawings that form a part hereof. These embodiments are described in sufficient detail to enable those skilled in the art to practice the disclosed subject matter, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

As used herein, the phrases "hydraulically coupled," "hydraulically connected," "in hydraulic communication," "fluidly coupled," "fluidly connected," and "in fluid communication" refer to a form of coupling, connection, or communication related to fluids, and the corresponding flows or pressures associated with these fluids. In some embodiments, a hydraulic coupling, connection, or communication between two components describes components that are associated in such a way that fluid pressure may be transmitted between or among the components. Reference to a fluid coupling, connection, or communication between two components describes components that are associated in such a way that a fluid can flow between or among the components. Hydraulically coupled, connected, or communicating components may include certain arrangements where fluid does not flow between the components, but fluid pressure may nonetheless be transmitted such as via a diaphragm or piston or other means of converting applied flow or pressure to mechanical or fluid force.

The present disclosure relates to a downhole tubular cutting system that includes a gas generator or other fluid displacement device to displace wellbore or other fluid between a cutter and downhole tubular. By displacing the fluid, which may be viscous or may be present at high pressures, the cutting efficiency and effectiveness of the cutter may be increased in some embodiments. The presently disclosed embodiments may be used in horizontal, vertical, deviated, or otherwise nonlinear wellbores in any type of subterranean formation. Embodiments may be implemented in drilling, completion or production operations to sever casing or other tubulars that have been positioned or installed in the wellbore.

Referring to FIG. 1, a schematic illustration of a downhole tubular cutting system 100 is provided. The downhole tubular cutting system 100 includes a cutter 104 that is positionable within a tubular 108 disposed in a wellbore 112. The tubular may be casing, liner, drill string, production tubing, or any other tubular capable of being disposed in the wellbore 112 and into which the downhole tubular cutting system 100 may be positioned. In the embodiment illustrated in FIG. 1, the tubular 108 may be casing. While shown as an explosive radial shaped-charge cutter in FIG. 1, the cutter 104 may instead be a chemical cutter, a thermal torch cutter, a fragmenting cutter, or any other cutter capable of being positioned in the tubular 108 and that would benefit from the displacement or removal of liquid surrounding the cutter 104.

The downhole tubular cutting system 100 further includes a fluid displacer such as a gas generator 114 having a generator body 116 and a gas production member 118. A first end 120 of the generator body 116 is coupled to the cutter 104. In an embodiment, the coupling of the cutter 104 and the generator body 116 may be accomplished using a threaded connection. In other embodiments, other connections may be employed including without limitation a press or friction fit connection, a twist-lock style connection, a connection using fasteners such as screws, rivets or other fasteners. Alternatively, the generator body 116 and the cutter 104 may be integrally formed as a single component. In FIG. 1, a second end 124 of the generator body 116 may be coupled to a detonator housing 130 in a coupling manner similar to that described previously with respect to the first end 120. For example, the generator body 116 and the detonator housing 130 may include complimentary threaded connections to allow a threaded coupling between the components. Alternatively, the components may be integrally formed as a single component, or may be connected by other connection mechanisms including without limitation a press or friction fit connection, a twist-lock style connection, a connection using fasteners such as screws, rivets or other fasteners.

As explained in more detail below with respect to FIG. 1, gas generation at the gas generator occurs rapidly and displacement of fluid in the wellbore therefore is not dependent on the gas bubble rising in the wellbore. In the embodiment illustrated in FIG. 1, the orientation and positioning of the cutter 104, gas generator 114, and detonator housing 130 is such that the cutter 104 is positioned downhole (i.e., further from a surface of the well measured along an axis of the wellbore) from the gas generator 114, and the gas generator 114 is positioned downhole from the detonator housing 130. Since gas generation with the embodiment of FIG. 1 occurs quickly, it is not necessary that the gas generator be located downhole of the cutter. However, if a slower gas generation technique were employed, the positioning of the cutter 104, gas generator 144 and detonator housing 130 could be reversed such that the gas generator is 144 is downhole from the cutter 104.

The generator body 116 may be generally cylindrical in shape with a passage 134 aligned with a longitudinal axis of the generator body 116. A barrier wall 138 may be positioned in the passage 134 to block fluid communication between a first portion 142 and a second portion 146 of the passage 134. As explained in more detail below, in the embodiment illustrated in FIG. 1, the barrier wall 138 is meant to block gas generated in the detonator housing 130 or first portion 142 of the passage 134 from being immediately communicated to the second portion 146 of the passage 134.

The detonator housing 130 may include a cavity 150 adapted to receive a detonator or igniter 154. In an embodiment, the detonator or igniter 154 may be the first initiation stage of a series of detonations or ignitions that are used to displace a fluid in the wellbore 112 that is positioned in an annulus 158 between the cutter 104 and the tubular 108. The detonator housing 130 has walls 162 shaped and sized to prevent any breach of the detonator housing 130 when the detonator or igniter 154 is detonated or ignited. The cavity 150 of the detonator housing 130 may be fluidly connected to the first portion 142 of the passage 134.

The detonator or igniter 154 may be any type of detonator or igniter 154 commonly used in downhole environments or with explosive cutters to initiate either detonation of detonation cord or other charges, or to initiate ignition of igniter fuse or other black powder based sources. The detonator or igniter 154 may be electrically connected by a wire 166 to the surface of the well or to downhole-located electronics. It should be recognized that communication between the surface of the well and the detonator or igniter 154 may alternatively be by optical communication or wireless transmission. The wire 166 is capable of carrying a firing signal to the detonator or igniter 154 to begin initiation of either detonation or ignition. When downhole electronics are included, the electronics may provide a safety circuit that prevents inadvertent initiation of the detonator or igniter 154. The electronics may further include wired or wireless transmitters and receivers to communicate with an operator at the surface of the well to receive initiation instructions.

In an embodiment, the detonator housing 130 may further include a gas brake 170 that is positioned near the first end 124 of the generator body 116. The gas brake 170 includes a brake surface 174 approximately normal to a longitudinal axis of the portion of the wellbore 112 at which the downhole tubular cutting system 100 is positioned. The brake surface 174 of the gas brake 170 provides an area that is approximately equal to an area of a corresponding cutter surface 178 of the cutter 104. The cutter surface 178 also may be approximately normal to the longitudinal axis of the portion of the wellbore 112 at which the downhole tubular cutting system 100 is positioned. By positioning surfaces with similar areas at both ends of the generator body 116, any forces produced by gases generated in the space surrounding the generator body 116 act equally on the brake surface 174 and the cutter surface 178, thereby preventing or significantly reducing axial movement of the downhole tubular cutting system 100 along the wellbore 112.

The gas production member 118 of the downhole tubular cutting system 100 includes a detonating cord or igniter fuse 182 disposed around the generator body 116. In an embodiment such as that illustrated in FIG. 1, the detonating cord or igniter fuse 182 is wrapped around the generator body 116 in a coiled configuration. The detonating cord or igniter fuse 182 may extend through a port 186 in the generator body 116 and into the first portion 142 of the passage 134. The detonating cord or igniter fuse 182 may be coupled to the detonator or igniter 154 such that initiation of the detonator or igniter 154 will propagate and travel to the detonating cord or igniter fuse 182. Similarly, the detonating cord or igniter fuse 182 may extend through a port 190 in the generator body 116 and into the second portion 146 of the passage 134. The detonating cord or igniter fuse 182 may then be coupled to a detonator 192 positioned within the cutter 104.

The detonating cord or igniter fuse 182 is comprised of a material that when detonated or burned is capable of producing a gas. When a detonating cord is used, high explosive may be disposed in a tube-like structure such as a plastic tube or other flexible housing that is capable of being wrapped around the generator body 116. Examples of high explosives include cyclotrimethylenetrinitramine (RDX) or cyclotetramethylene-tetranitramine, tetrahexamine tetranitramine, or octahydro-1,3,5,7-tetranitro-1,3,5,7-tetrazocine (HMX). Other possible explosives include pentaerythritol tetranitrate (PETN), hexanitrostilbene (HNS), or any explosive material that is capable of generating a gas but not damaging the nearby cutter 104. Common propagation speeds for detonating cord (i.e., the speed of the detonation) are about 26,000-27,000 feet per second. Detonation of the detonating cord is capable of producing gases which include carbon monoxide, carbon dioxide, and nitrogen. As an alternative to detonating cord, igniter fuse may be used to generate gas. Igniter fuse is commonly black powder based and burns rather than detonates. Common propagation speeds for igniter cord (i.e., the speed of the burn) are about 100 feet per second, but the propagation speed may be faster in the high pressure environment downhole. Similar to detonating cord, the gases produced by burning the igniter cord are carbon monoxide, carbon dioxide, and nitrogen.

The cutter 104 illustrated in FIG. 1 is a radial cutter that includes a main charge 196 positioned within a housing 202. The main charge 196 may be shaped and may include a liner 206 that is capable of being driven by the detonation of the main charge 196 into the tubular 108 to sever or cut the tubular 108. A passage 210 extends longitudinally through the main charge 196 and cutter housing 202, and a booster 214 is coupled to the main charge 196 proximate or adjacent the passage 210. The detonator 192 may be positioned proximate or adjacent the booster 214 such that initiation of the detonator 192 causes detonation of the booster 214 and then detonation of the main charge 196. Both the detonator 192 and the booster 214 may comprise a high explosive similar to the explosive used with the detonating cord 182. It is important to note that when igniter fuse 182 is used instead of the detonating cord, the igniter fuse 182 is also capable of initiating detonation of the detonator 192 to then detonate the booster 214 and the main charge 196.

The number of windings of the detonating cord or igniter fuse 182 around the generator body 116 is capable of influencing the amount of gas generated in an area around the gas generator 116 and the cutter 194, which in turn influences the displacement of the wellbore fluid around the cutter 104. The longitudinal length of the generator body 116 may be selectively varied depending on the pressure of wellbore fluid anticipated. For example, in many instances, a deeper well will result in wellbore fluids with higher pressures, and to displace these fluids, larger volumes of gas must be generated quickly. In these instances, it may be desirable to have a longer or larger generator body 116 to accommodate additional lengths of detonating cord or igniter fuse 182 to produce more gas. In wells with lower fluid pressures, it may be suitable to use a smaller or shorter generator body with less detonating cord or igniter fuse 182 to produce less gas.

In operation, the various components of the downhole tubular cutting system 100 including the cutter 104 have an outer diameter less than an inner diameter of the tubular 108 into which the downhole tubular cutting system 100 is to be run. The downhole tubular cutting system 100 is illustrated in FIG. 1 in a pre-initiation stage in which the detonator or igniter 154 has not received a firing signal along the wire 166. Consequently, no gas generation or other fluid displacement has occurred, and the annulus 158 may still include wellbore fluid.

Figure 2:
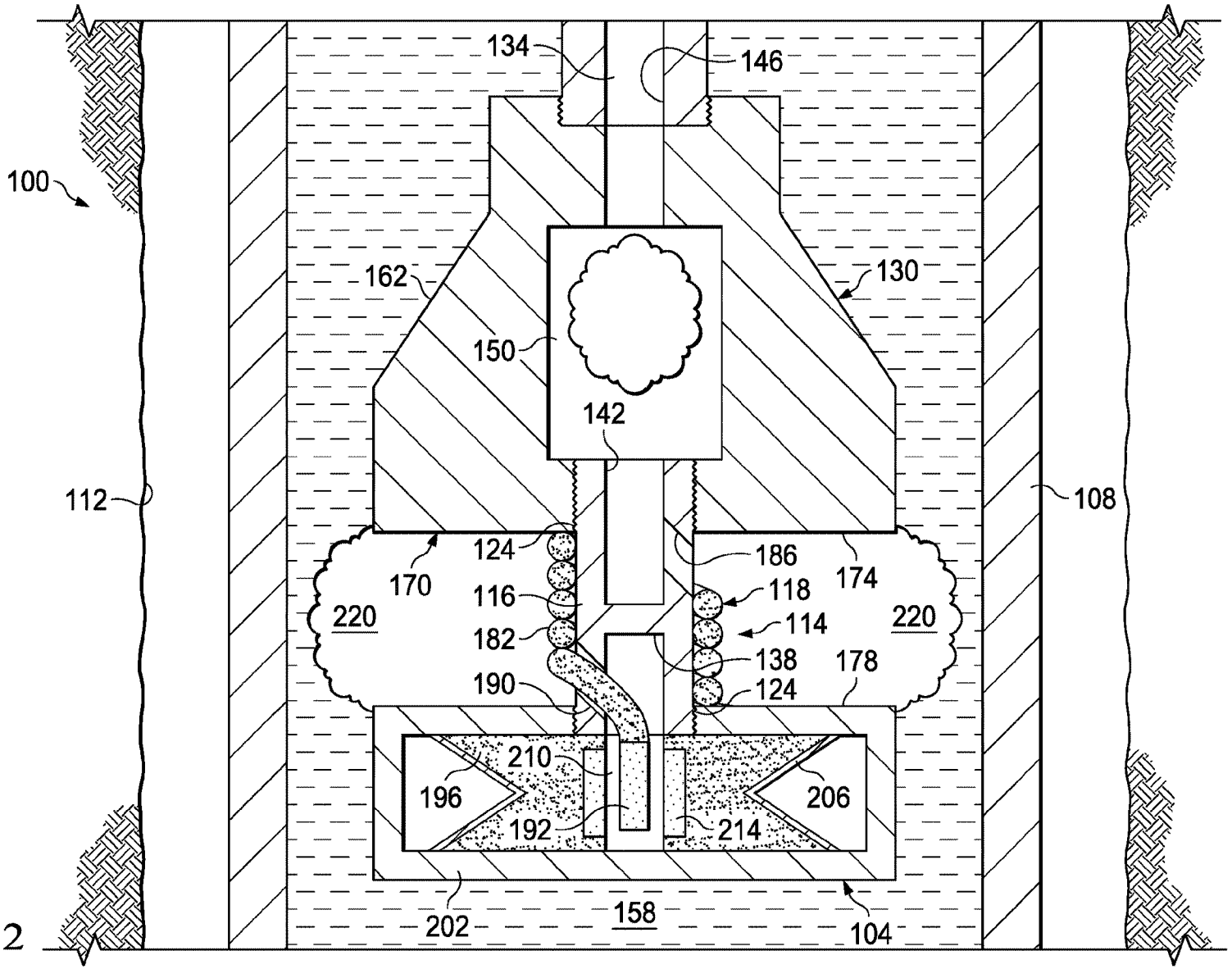
FIG. 2 illustrates a schematic view of the downhole tubular cutting system of FIG. 1, the cutting system being shown in a fluid displacement stage.

Referring to FIG. 2, a schematic view of the downhole tubular cutting system 100 is shown in a fluid displacement stage. In this stage, an operator at the surface of the well causes a firing signal to be transmitted along the wire 166 to the detonator or igniter 154. Initiation is a top-down process in the embodiment illustrated in FIGS. 1 and 2, but depending on the inclination of the wellbore and the positioning of the cutter 104 relative to the generator body 116, the initiation could instead be a bottom-up process. In FIG. 2, detonation or ignition of the detonator or igniter 154 has occurred, and this detonation or ignition begins the detonation or ignition of the detonating cord or igniter fuse 182 around the generator body 116. As the detonating cord or igniter fuse 182 detonates or ignites, gas 220 is produced and quickly fills the space around the generator body 116. The forces created by the gas generation move out in all directions, but due to the presence of the approximately equal surface areas of the brake surface 174 and the cutter surface 178, the forces against the downhole tubular cutting system 100 in the axial direction are balanced, which reduces axial movement of the cutter 104 during this fluid displacement stage. This is beneficial since it is often desired that the cutter 104 be precisely positioned to make the cut of the tubular 108 in a specific location.

As the gas generated by the detonation or ignition of the detonating cord or igniter fuse 182 quickly spreads in the space surround the generator body 116, the gas moves uphole and downhole and begins to displace the wellbore fluid in the annulus 158 around the cutter 104. The gas essentially forms a low density bubbly that displaces wellbore fluid between the cutter 104 and the tubular 108.

Figure 3:
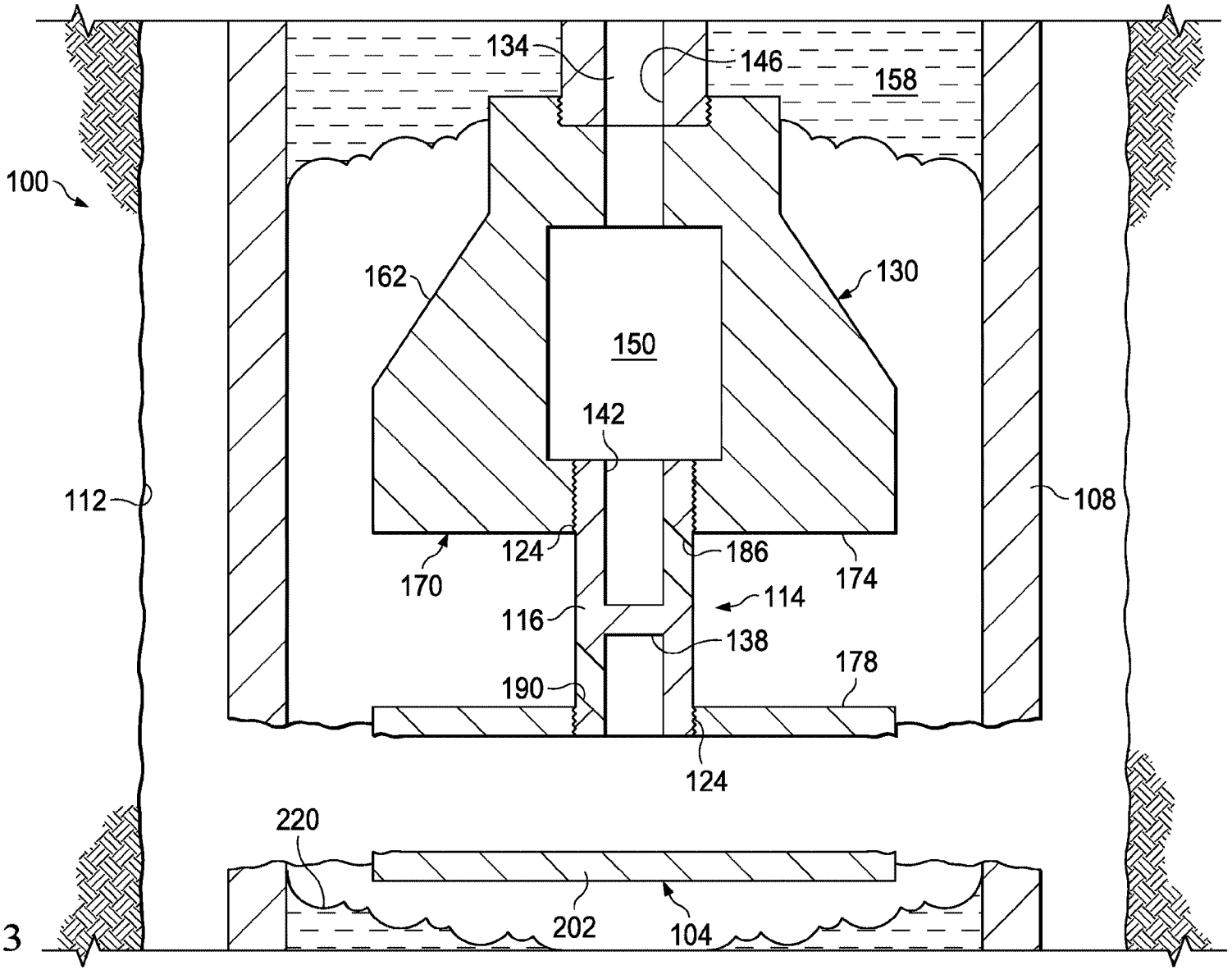
FIG. 3 illustrates a schematic view of the downhole tubular cutting system of FIG. 1, the cutting system being shown in a cutting stage.

Referring to FIG. 3, a schematic view of the downhole tubular cutting system 100 is shown in a cutting stage. At this stage, the gas 220 has expanded to displace wellbore fluid between the cutter 104 and the tubular 108. As the detonating cord or igniter fuse 182 continues to detonate or ignite in the fluid displacement stage of FIG. 2, the detonation or ignition propagates to the detonator 192, which initiates detonation at the cutter 104, first in the detonator 192, then in the booster 214, and finally in the main charge 196. The main charge explodes at a high rate of speed and force and pushes the liner 206 radially outward to penetrate and cut the tubular 108.

The displacement of wellbore fluid surrounding the cutter 104 improves the cutting efficiency of the cutter 104 compared to that of a cutter attempting to cut through a high pressure wellbore fluid. By increasing cutting efficiency, it is possible to minimize the explosive weight associated with the cutter 104, which allows smaller cutters to be used for jobs that previously required larger cutters. This reduces cost and also allows a particular cutter size to be capable of cutting tubulars with a wider range of inner diameters and thicknesses.

Figure 4:
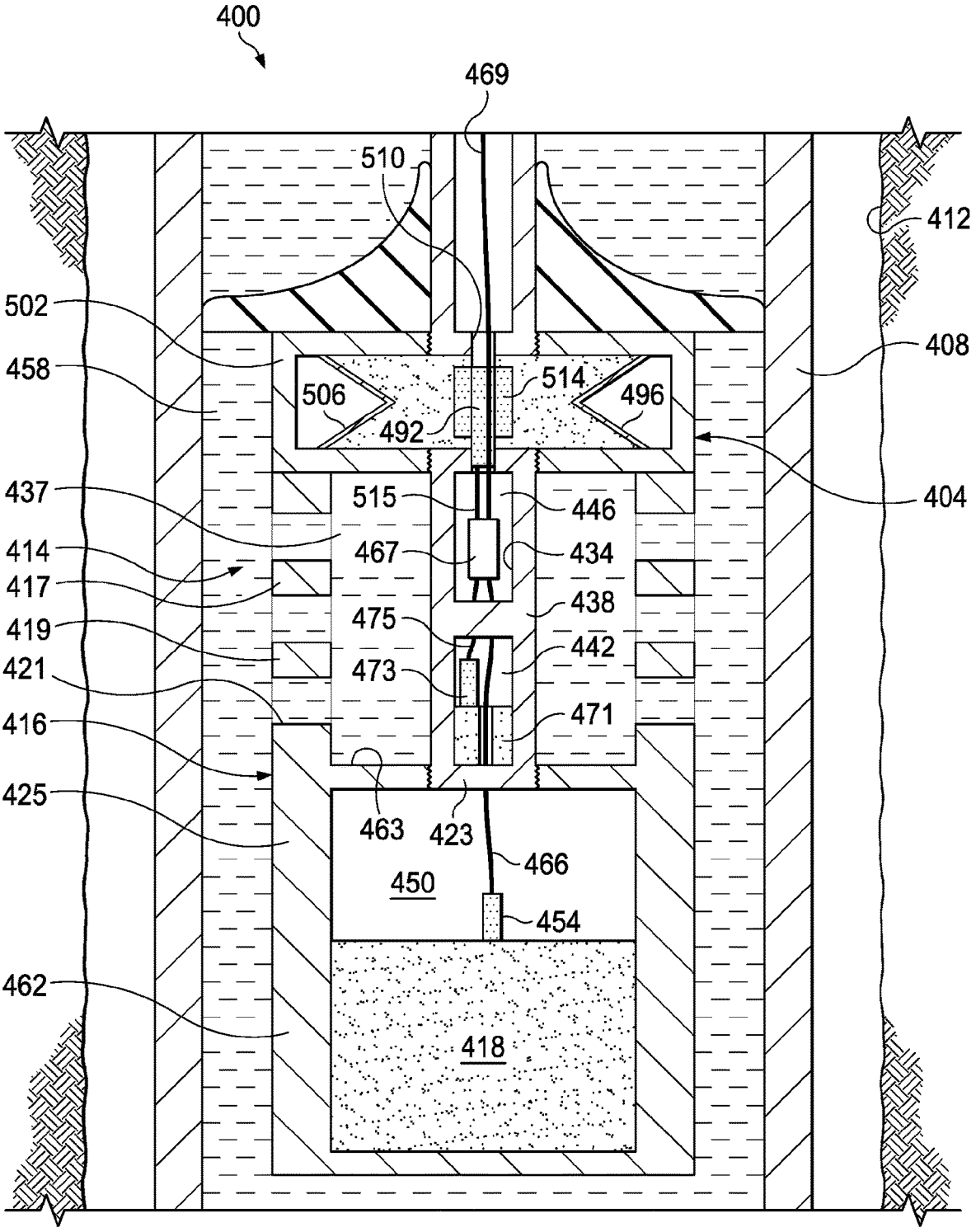
FIG. 4 illustrates a schematic view of a downhole tubular cutting system according to an illustrative embodiment, the cutting system being shown in a pre-initiation stage.

FIG. 4 is a schematic view of a downhole tubular cutting system 400 according to an embodiment. The downhole tubular cutting system 400 includes a cutter 404 that is positionable within a tubular 408 disposed in a wellbore 412. Similar to the tubular 108 of FIGS. 1-3, the tubular 408 may be casing, liner, drill string, production tubing, or any other tubular capable of being disposed in the wellbore 412 and into which the downhole tubular cutting system 400 may be positioned. In the embodiment illustrated in FIG. 4, the illustrated tubular 408 is casing. While shown as an explosive radial shaped-charge cutter in FIG. 4, the cutter 404 may be a chemical cutter, a thermal torch cutter, a fragmenting cutter, or any other cutter capable of being positioned in the tubular 408 and that would benefit from the displacement or removal of liquid surrounding the cutter 404.

The downhole tubular cutting system 400 further includes a fluid displacer such as a gas generator 414 having a generator body 416 and a gas production member 418. The generator body 416 includes a first body member 417 coupled to the cutter 404. The first body member 417 includes an outer member 419 having a plurality of vents 421 and an inner member 423 concentrically disposed within the outer member 419. In an embodiment, the coupling of the cutter 404 and the generator body 416 may be accomplished using a threaded connection. In other embodiments, other connections may be employed including without limitation a press or friction fit connection, a twist-lock style connection, a connection using fasteners such as screws, rivets or other fasteners. Alternatively, the generator body 416 and the cutter 404 may be integrally formed as a single component.

The generator body 416 further includes a second body member 425 coupled to the first body member 417. The coupling between the various components of the generator body 416 may be accomplished by a threaded connection or any other connection such as those described previously. Similarly, some components of the generator body 416 may be integrally connected or formed.

In the embodiment illustrated in FIG. 4, the orientation and positioning of the cutter 404 and the gas generator 414 is such that the gas generator 414 is positioned downhole from the cutter 404. While the portion of the wellbore 412 in which the downhole tubular cutting system 400 is positioned may be horizontal, in many situations the wellbore 412 may be inclined vertically or partially vertical (i.e., inclinations other than ninety degrees) and the presence of the gas generator 414 downhole of the cutter 400 allows gas generated by the gas generator 414 to rise in the wellbore toward the cutter 400. In situations where the wellbore may have inclinations greater than ninety degrees, it may be desirable to re-position the components of the downhole tubular cutting system 400 such that the gas generator 414 is positioned uphole from the cutter 104. In these inclinations, the presence of the gas generator 414 uphole of the cutter 400 allows gas generated near the gas generator 414 to rise in the wellbore toward the cutter 400.

The first body member 417 of the generator body 416 includes an annulus 437 formed between the outer member 419 and the inner member 423 of the first body member 417. The annulus 437 is in fluid communication with an annulus 458 between the cutter 404 and the tubular 408. The inner member 423 of the first body member 417 includes a passage 434 bifurcated by a barrier wall 438 to block fluid communication between a first portion 442 and a second portion 446 of the passage 434. As explained in more detail below, in the embodiment illustrated in FIG. 4, the barrier wall 438 is meant to protect components in the second portion 446 of the passage 434 during a detonation that occurs in the first portion 442 of the passage 434.

The second body member 425 may include a cavity 450 adapted to receive the gas production member 418 and an igniter 454. In an embodiment, the igniter 454 may be the first initiation stage of a series of ignitions and detonations that are used to displace a fluid in the wellbore 412. The second body member 425 has an annular wall 462 shaped and sized to prevent any breach of the second body member 425 during ignition of igniter 454 and burning of gas production member 418. The second body member 425 further includes an end wall 463 that prevents fluid communication between the cavity 450 and the annulus 437 and also prevents fluid communication between the cavity 450 and the first portion 442 of the passage 434.

The igniter 454 may be any type of igniter 454 commonly used in downhole environments to initiate ignition of igniter fuse or other black-powder-based materials. The igniter 454 may be electrically connected to a wire 466 that may run to downhole electronics used to initiate a firing sequence. In an embodiment, the electronics may comprise an initiation control module 467 positioned in the second portion 446 of the passage 434. The initiation control module 467 may include wired or wireless transmitters or receivers and a processing unit to receive instructions from an operator at the surface of the well and transmit firing signals. In the embodiment illustrated in FIG. 4, the initiation control module 467 is electrically connected to the surface by a wire 469. The initiation control module 467 may provide a safety circuit that prevents inadvertent initiation of the igniter 454. In FIG. 4, the wire 466 passes through a port (not illustrated) in the barrier wall 438 that may be sealed to prevent passage of gases through the port.

While communication between the surface of the well, downhole electronics and detonators or igniters is described herein as an electrical connection over wires, it should be appreciated that the communication may occur optically, wirelessly, or by other transmission techniques.

The gas production member 418 may be comprised of a material that when detonated or burned is capable of producing a gas at a rate controlled enough to avoid breach of the generator body 416. In an embodiment, the gas production member 418 is one or more gas generation pellets. The pellets may be comprised of a black-powder-based material or other material that burns to produce gases such as carbon monoxide, carbon dioxide, and nitrogen. Other examples include gas generators typically used in setting tools, otherwise known as power charges. These are often simply an oxidizer such as potassium nitrate, sodium nitrate, ammonium nitrate or similar perchlorate oxidizers. These are typically mixed with a fuel material in the form of a binder such as epoxy or other carbon-based glue or adhesive.

The amount of gas production member 418 provided in the generator body 416 is capable of influencing the amount of gas produced that may be used to displace fluid around the cutter. In instances where cutting of a tubular is desired at a deeper well depth or where wellbore fluids have higher pressures, a greater amount of gas production member 418 is desired to generate a larger volume of gas. In these instances, it may be desirable to have a longer or larger generator body 416 to accommodate the additional amount of gas production member 418. In wells with lower fluid pressures, it may be suitable to use a lesser amount of gas production member 418 and a smaller or shorter generator body 416. Unlike the gas generation described in FIGS. 1-3, which relies on a rapid production of gas that quickly displaces the wellbore fluid, the generation of gas by gas production member 418 relies on a slower generation of gas to first collect the gas in the cavity 450 of the second body member 425 prior to any displacement of any wellbore fluid.

In an embodiment, the first portion 442 of the passage 434 may include an explosive venting charge 471 that is configured upon detonation to remove the end wall 463 and a portion of the inner member 423 surrounding the first portion 442 of the passage 434. A detonator 473 is coupled to or placed in proximity to the explosive venting charge 471 and is configured to initiate detonation of the explosive venting charge 471. The detonator 473 may be electrically connected by a wire 475 to the initiation control module 467 such that a signal sent from the initiation control module 467 to the detonator 473 triggers detonation of the detonator 467 and the explosive venting charge 471. Both the detonator 473 and the explosive venting charge 471 may comprise a high explosive similar to the explosive used with the detonating cord 182 described in FIGS. 1-3.

The cutter 404 illustrated in FIG. 4 is a radial cutter that includes a main charge 496 positioned within a housing 502. The main charge 496 may be shaped and may include a liner 506 that is capable of being driven by the detonation of the main charge 496 into the tubular 408 to sever or cut the tubular 408. A passage 510 extends longitudinally through the main charge 496 and the housing 502, and a booster 514 is coupled to the main charge 496 proximate or adjacent the passage 510. A detonator 492 may be positioned proximate or adjacent the booster 514 such that initiation of the detonator 492 causes initiation of the booster 514 and then detonation of the main charge 496. The detonator 492 may be electrically connected by a wire 515 to the initiation control module 467 such that a signal sent from the initiation control module 467 to the detonator 492 may trigger detonation of the detonator 492, the booster 514, and the main charge 496. The main charge 496, the detonator 492, and the booster 514 may comprise a high explosive similar to the explosive used with the detonating cord 182 described in FIGS. 1-3.

In operation, the various components of the downhole tubular cutting system 400 including the cutter 404 have an outer diameter less than an inner diameter of the tubular 408 into which the downhole tubular cutting system 400 is to be run. The downhole tubular cutting system 400 is illustrated in FIG. 1 in a pre-initiation stage in which the detonator 454 has not received a firing signal along the wire 466. Consequently, no gas generation or other fluid displacement has occurred, and the annulus 458 may still include wellbore fluids.

Figure 5:
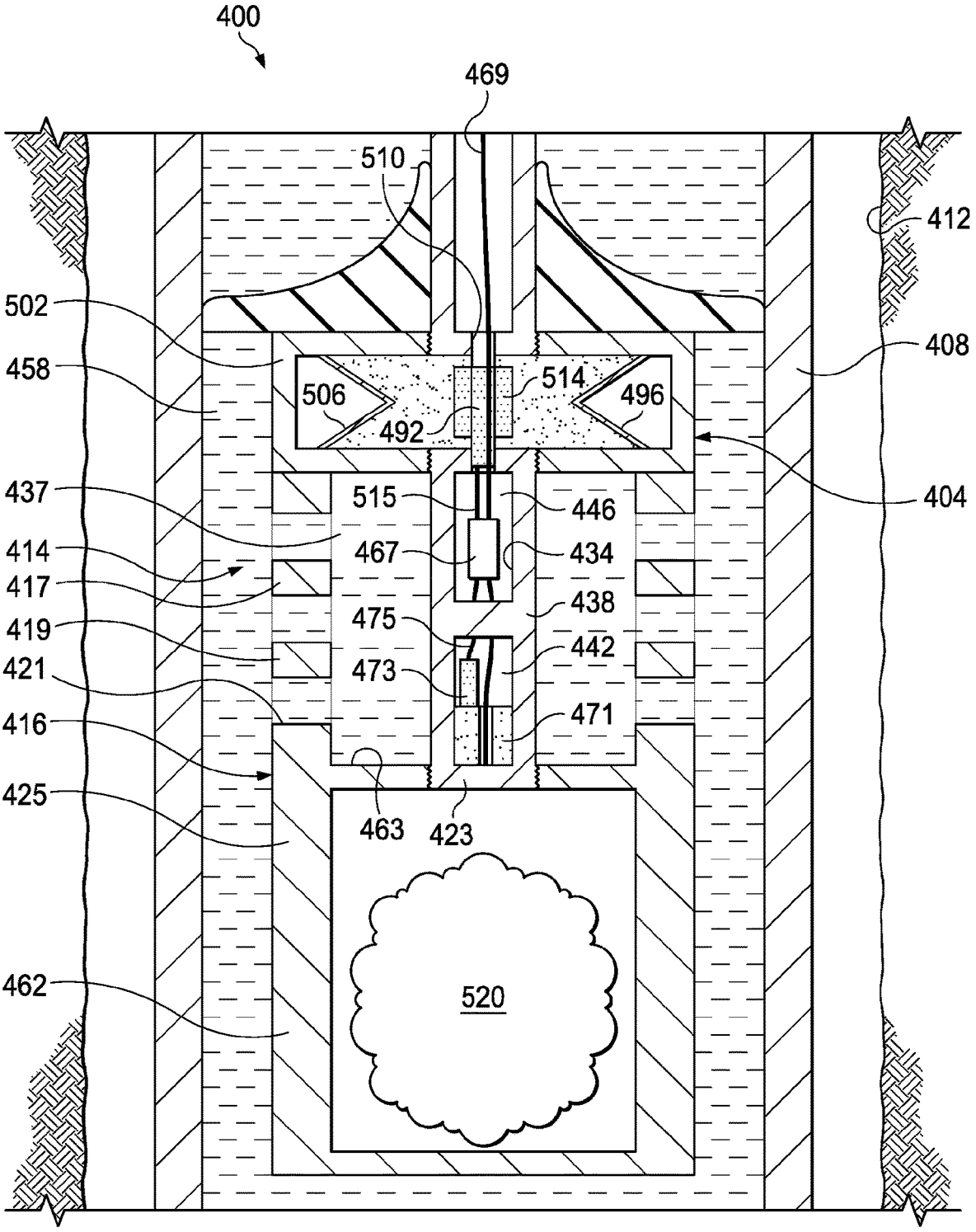
FIG. 5 illustrates a schematic view of the downhole tubular cutting system of FIG. 4, the cutting system being shown in a gas generation stage.

Referring to FIG. 5, a schematic view of the downhole tubular cutting system 400 is shown in a gas generation stage. In this stage, an operator at the surface of the well causes the initiation control module 467 to transmit a firing signal along the wire 466 to the detonator 454. Initiation is a bottom-up process in the embodiment illustrated in FIGS. 4 and 5, but depending on the inclination of the wellbore and the positioning of the cutter 404 relative to the generator body 416, the initiation could instead be a top-down process. In FIG. 5, detonation of the detonator 454 occurs, which ignites gas production member 418 inside the cavity 450. The burning of the gas production member 418 produces a gas 520 which slowly builds in pressure within the cavity 450 as additional gas is produced. Since the gas 520 production occurs slowly, there is a decreased need for a gas brake such as the one described for downhole tubular cutting system 100.

Following gas generation, the initiation control module 467 sends a firing signal to the detonator 473 to initiate detonation of the explosive venting charge 471. While the timing of sending the firing signal to the detonator 473 may be an automatically controlled process, the process may instead be controlled manually by the operator. When automated, detonation of the detonator 473 may occur a certain amount of time after the firing signal is sent to the detonator 454. In an embodiment, a delay of about one minute may be allowed between initiation of the detonator 454 and initiation of the detonator 473. Alternatively, a pressure within the cavity 450 may be monitored, and the initiation control module 467 may provide the firing signal to the detonator 473 after the pressure in the cavity 450 reaches a selected level, thereby indicating the presence of a suitable pressure of gas 520. When the detonator 473 and explosive venting charge 471 are detonated, the detonation removes a portion of the end wall 463 and a portion of the inner member 423 surrounding the first portion 442 of the passage 434.

Figure 6:
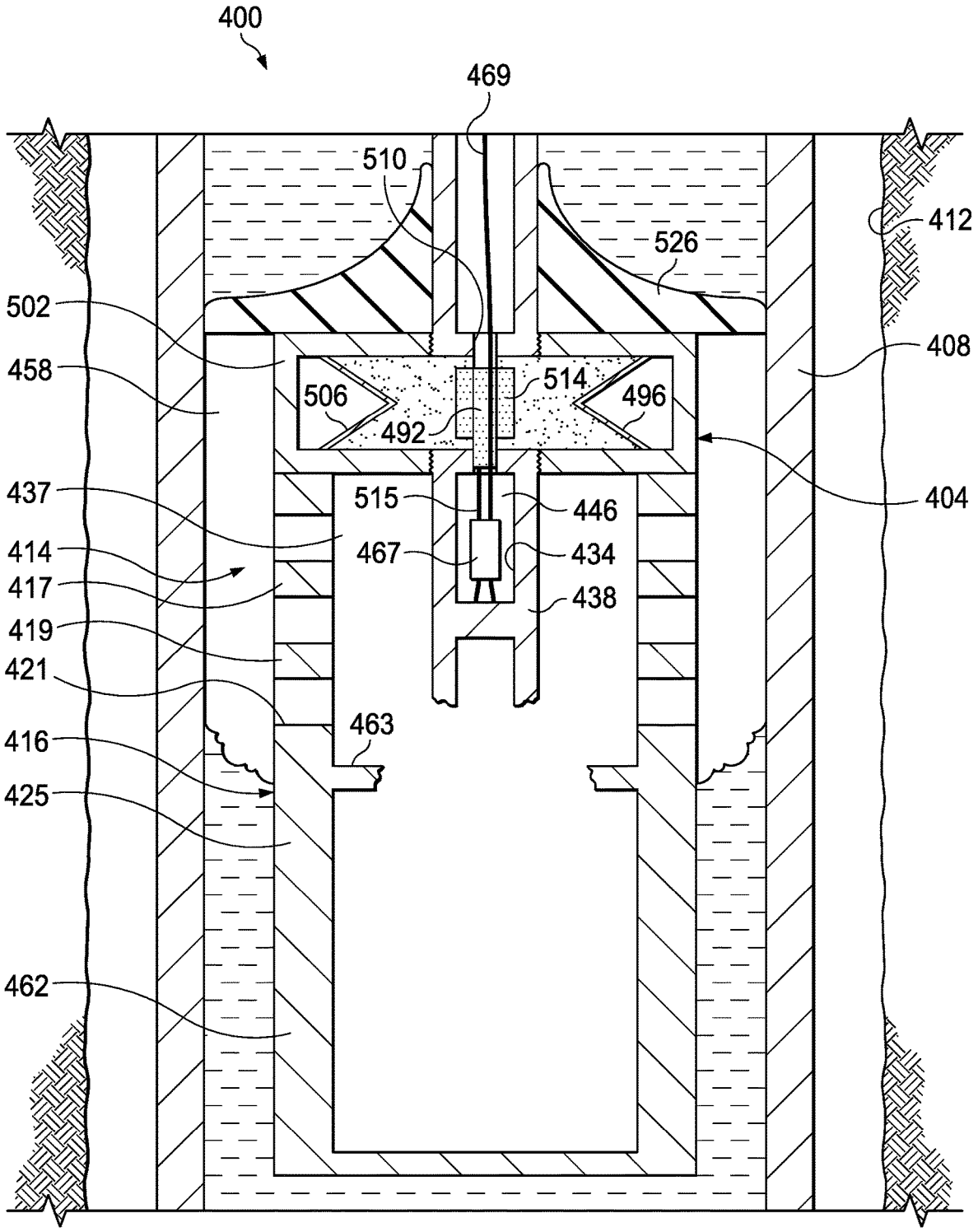
FIG. 6 illustrates a schematic view of the downhole tubular cutting system of FIG. 4, the cutting system being shown in a fluid displacement stage.

Referring to FIG. 6, a schematic view of the downhole tubular cutting system 400 is shown in a fluid displacement stage. During the gas generation stage of FIG. 5, the gas 520 is generated in the cavity 450 and then detonation is initiated of the detonator 473 and explosive venting charge 471. This blast and the removal of the nearby walls allows fluid communication between the cavity 450 and the annulus 437. Fluid communication also occurs between the annulus 437 and the annulus 458 through the vents 421. Following this detonation, the gas 520 in cavity 450 moves into the annulus 437 and the annulus 458. As the gas moves into the annulus 437, the gas moves uphole and downhole forming a low density bubble that displaces wellbore fluid between the cutter 404 and the tubular 408. As the gas 520 rises in the annulus 437, the gas may be captured by a swab cup 526 positioned uphole of the cutter 404. The swab cup 526 may be a flexible elastomeric cup that is configured to engage a wall of the tubular 408 to prevent migration of the gas 520 uphole past the cutter 404. The swab cup 526 helps ensure that liquid is displaced around the cutter 404 and may be used with the slow gas generation technique of downhole tubular cutting system 400 or the faster gas generation technique of downhole tubular cutting system 100.

Figure 7:
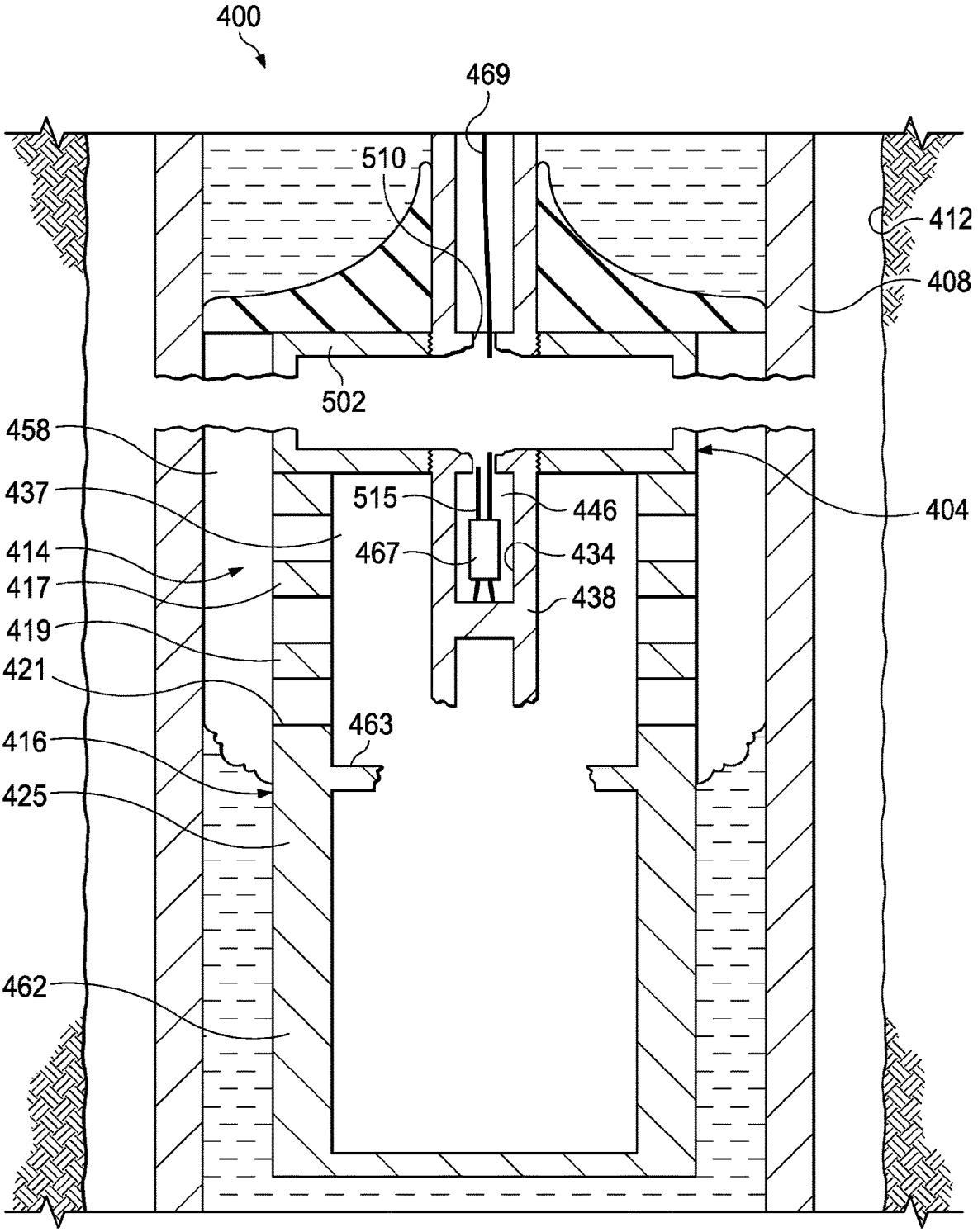
FIG. 7 illustrates a schematic view of the downhole tubular cutting system of FIG. 4, the cutting system being shown in a cutting stage.

Referring to FIG. 7, a schematic view of the downhole tubular cutting system 400 is shown in a cutting stage. Following displacement of the wellbore fluid, the initiation control module 467 sends a firing signal to the detonator 492 to initiate detonation at the cutter 404, first in the detonator 492, then in the booster 514, and finally in the main charge 496. In an embodiment, a delay of about one minute may be allowed between initiation of the detonator 473 and initiation of the detonator 492 to allow sufficient displacement of the wellbore liquid by the gas 520. Alternatively, a pressure within the annulus 458 may be monitored, and the initiation control module 467 may provide the firing signal to the detonator 492 after the pressure in the annulus 458 reaches a selected level, thereby indicating the presence of a suitable amount of gas 520. Upon initiation of the detonator 492, the main charge 496 explodes at a high rate of speed and force and pushes the liner 506 radially outward to penetrate and cut the tubular 408. The displacement of wellbore fluid surrounding the cutter 404 improves the cutting efficiency of the cutter 404 as explained previously with reference to the downhole tubular cutting system 100 of FIGS. 1-3.

Figure 8:
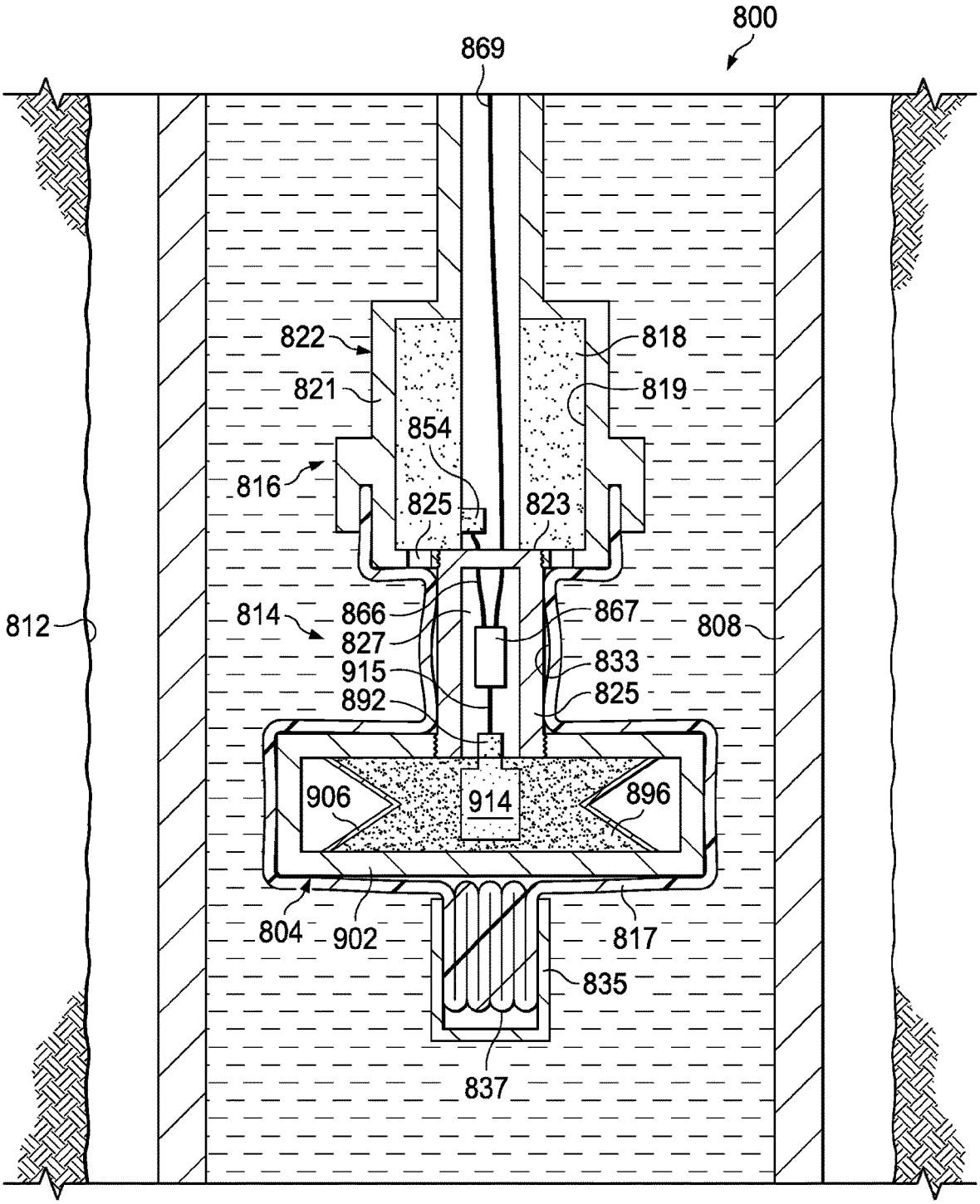
FIG. 8 illustrates a schematic view of a downhole tubular cutting system according to an illustrative embodiment, the cutting system being shown in a pre-initiation stage.

FIG. 8 is a schematic view of a downhole tubular cutting system 800 according to an embodiment. The downhole tubular cutting system 800 includes a cutter 804 that is positionable within a tubular 808 disposed in a wellbore 812. Similar to the tubulars of FIGS. 1-7, the tubular 808 may be casing, liner, drill string, production tubing, or any other tubular capable of being disposed in the wellbore 812 and into which the downhole tubular cutting system 800 may be positioned. In the embodiment illustrated in FIG. 8, the illustrated tubular 808 is casing. While shown as an explosive radial shaped-charge cutter in FIG. 8, the cutter 804 may be another type of cutter similar to those described previously with reference to FIGS. 1-7.

The downhole tubular cutting system 800 further includes a fluid displacer such as a gas generator 814 having a generator body 816, an expandable member 817, and a gas production member 818. The generator body 816 includes a first body member 822 coupled to a second body member 825, which is in turn coupled to the cutter 804. The coupling configurations between components of the downhole tubular cutting system 800 may be any combination of threaded connections, integral connections, or other connections as described herein with reference to FIGS. 1-7.

The first body member 822 of the generator body 816 includes a cavity 819 defined at least partially by an annular wall 821 and an end wall 823. The end wall 823 includes a plurality of vents 825 that allow fluid communication through the end wall 823. The second body member 825 includes a passage 827 that is separated from the cavity 819 and is adapted to house an initiation control module 867. Similar to the initiation control module 467 of FIGS. 4-7, the initiation control module 867 is configured to receive instructions from an operator and then initiate one or more ignitions or detonations that result in displacement of wellbore fluid and cutting of the tubular 808. While communication from the operator to the initiation control module 867 may be wireless, the initiation control module 867 may instead be electrically connected to the surface of the well by a wire 869. The initiation control module 867 is further communicatively connected to an igniter 854 disposed within the cavity 819 of the first body member 822. The igniter 854 is coupled to the gas production member 818 to selectively initiate ignition of the gas production member 818.

The expandable member 817 of the gas generator 814 may be an airbag or other flexible gas impermeable membrane that is disposed around at least the cutter 804. In the embodiment illustrated in FIG. 8, the expandable member 817 is disposed around portions of the generator body 816 and extends completely around the cutter 804. The expandable member may be sealingly coupled to the first body member 822 such that an interior 833 of the expandable member 817 contains the second body member 825 and the cutter 804. The vents 825 allow fluid communication between the cavity 819 and the interior 833 of the expandable member 817.

In some embodiments, the expandable member 817 may comprise an elastomeric or otherwise deformable material that is capable of stretching when gas is injected into the interior 833 of the expandable member 817. In other embodiments, the expandable member 817 may comprise a less deformable material that requires excess material to be present in order to enable expansion of the expandable member 817. In FIG. 8, a hopper 835 is provided at a terminal end of the cutter 804 to receive excess material 837 associated with the expandable member 817. In these embodiments, when the expandable member 817 is expanded, the excess material 837 is configured to feed out of the hopper 835 to allow expansion of the expandable member 817 to an expanded position in which the expandable member 817 contacts the tubular 808. In FIG. 8, the expandable member 817 is in a collapsed position prior to being expanded.

The gas production member 818 may be comprised of a material that when burned is capable of producing a gas at a rate controlled enough to avoid breach of the first body member 817 but filling the expandable member 817 to the expanded position. In an embodiment, the gas production member 818 is one or more gas generation pellets. The pellets may be comprised of a black-powder-based material or other material that burns to produce gases such as carbon monoxide, carbon dioxide, and nitrogen. Examples of such gas generator materials could be sodium azide or other automotive airbag propellants, or the gas generator materials previously mentioned for use in setting tools, that is, power charges.

The amount of gas production member 818 provided in the generator body 816 is capable of influencing the amount of gas generated that may be used to displace fluid around the cutter. Higher amounts of gas production member 818 may be provided when higher wellbore fluid pressures are encountered, such as in deep wellbores, while lower amounts may be used when lower wellbore fluid pressures are expected.

In the embodiment illustrated in FIG. 8, the orientation and positioning of the cutter 804 and the gas generator 814 is such that the gas generator 814 is positioned uphole from the cutter 804. While the inclination of the wellbore 812 at the location where cutting is to occur may have an effect on relative positioning of the gas generator 814 and cutter 804 in embodiments that rely on the rise of gas in the wellbore, the present embodiment is not restricted in orientation since the generated gas is captured in the expandable member 817. Consequently, the orientation illustrated in FIG. 8 could be reversed such that the gas generator 814 is positioned downhole form the cutter 804 for any particular wellbore orientations. It is also important to note that the present embodiment is particularly useful in cutting tubulars positioned in horizontal or near-horizontal wellbores.

The cutter 804 illustrated in FIG. 8 is a radial cutter that includes a main charge 896 positioned within a housing 902. The main charge 896 may be shaped and may include a liner 906 that is capable of being driven by the detonation of the main charge 896 into the tubular 808 to sever or cut the tubular 808. A booster 914 is coupled to the main charge 896, and a detonator 892 may be positioned proximate or adjacent the booster 914 such that initiation of the detonator 892 causes detonation of the booster 914 and then detonation of the main charge 896. The detonator 892 may be electrically connected by a wire 915 to the initiation control module 867 such that a signal sent from the initiation control module 867 to the detonator 892 may trigger detonation of the detonator 892, the booster 914, and the main charge 896. The main charge 896, the detonator 892, and the booster 914 may comprise a high explosive similar to the explosive used with the detonating cord 182 described in FIGS. 1-3.

In operation, the various components of the downhole tubular cutting system 800 including the cutter 804 have an outer diameter less than an inner diameter of the tubular 808 into which the downhole tubular cutting system 800 is to be run. The downhole tubular cutting system 800 is illustrated in FIG. 8 in a pre-initiation stage in which the detonator 854 has not received a firing signal along the wire 866. Consequently, no gas generation has occurred and the expandable member 817 is still in the collapsed position.

Figure 9:
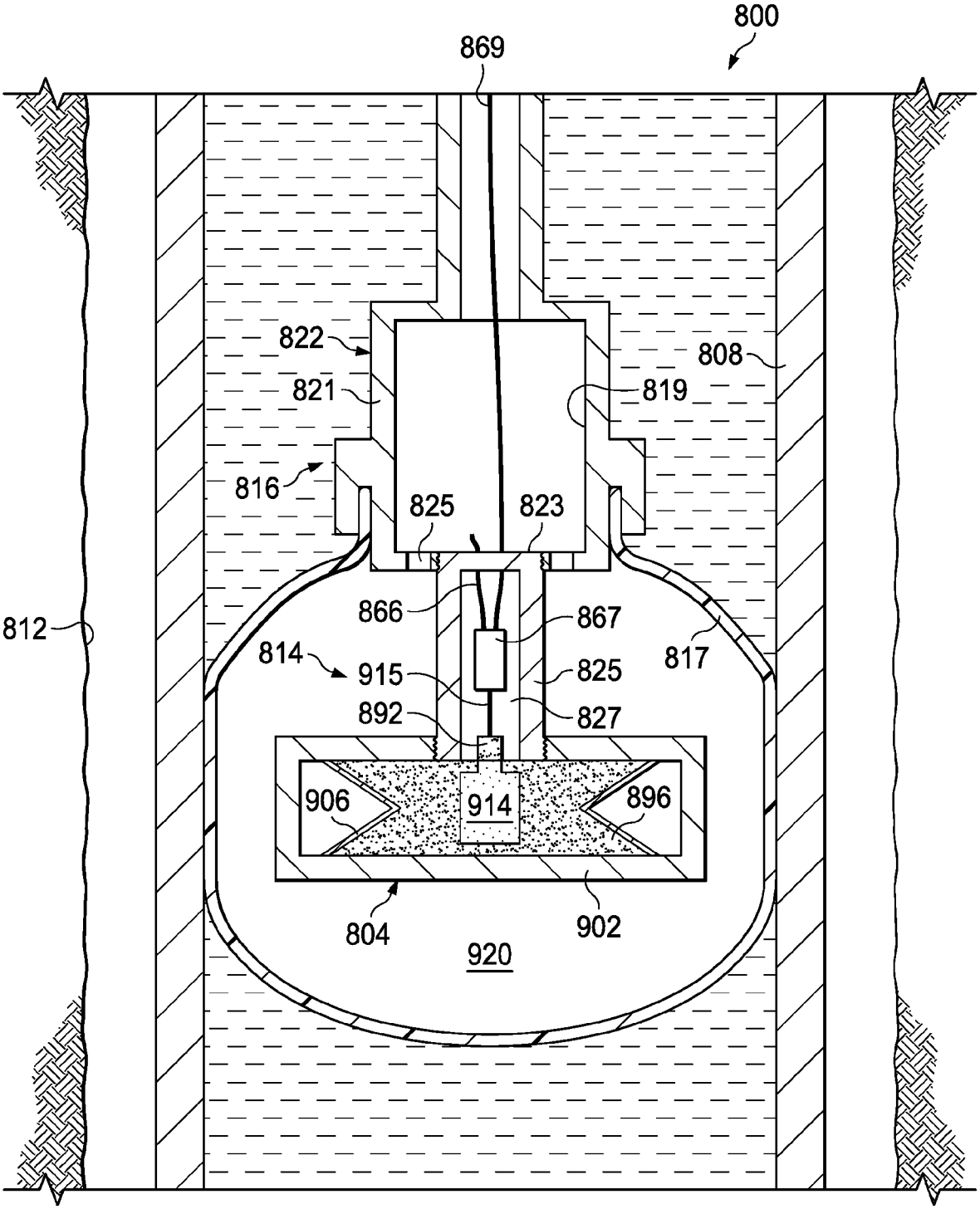
FIG. 9 illustrates a schematic view of the downhole tubular cutting system of FIG. 8, the cutting system being shown in a fluid displacement stage.

Referring to FIG. 9, a schematic view of the downhole tubular cutting system 800 is shown in a fluid displacement stage. In this stage, gas 920 is generated in the cavity 819 by initiating ignition of the igniter 854, which in turn ignites the gas production member 818 to generate gas. The gas 920 expands through the vents 825 and into the interior 833 of the expandable member 817. The expandable member then moves from the collapsed positioned into the expanded position shown in FIG. 9. In this position, the expandable member 817 expands into contact with the tubular 808 and displaces the wellbore fluid surrounding the cutter 804.

Figure 10:
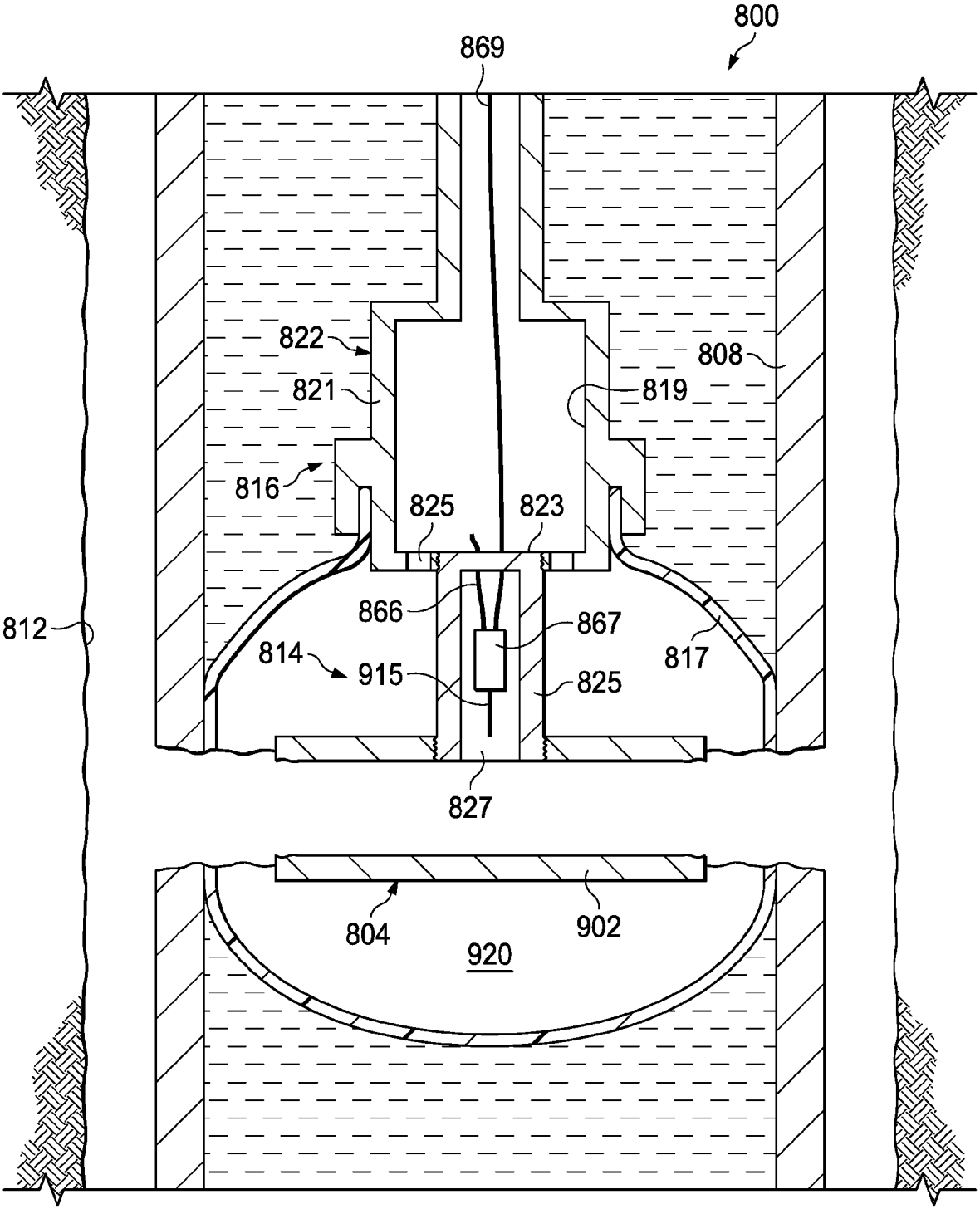
FIG. 10 illustrates a schematic view of the downhole tubular cutting system of FIG. 8, the cutting system being shown in a cutting stage.

Referring to FIG. 10, a schematic view of the downhole tubular cutting system 800 is shown in a cutting stage. Following displacement of the wellbore fluid, the initiation control module 867 sends a firing signal to the detonator 892 to initiate detonation at the cutter 804, first in the detonator 892, then in the booster 914, and finally in the main charge 896. The main charge 896 explodes at a high rate of speed and force and pushes the liner 906 radially outward to penetrate and cut the tubular 808. The displacement of wellbore fluid surrounding the cutter 804 improves the cutting efficiency of the cutter 804 as explained previously with reference to the downhole tubular cutting systems 100 and 400 of FIGS. 1-7.

Figure 11:
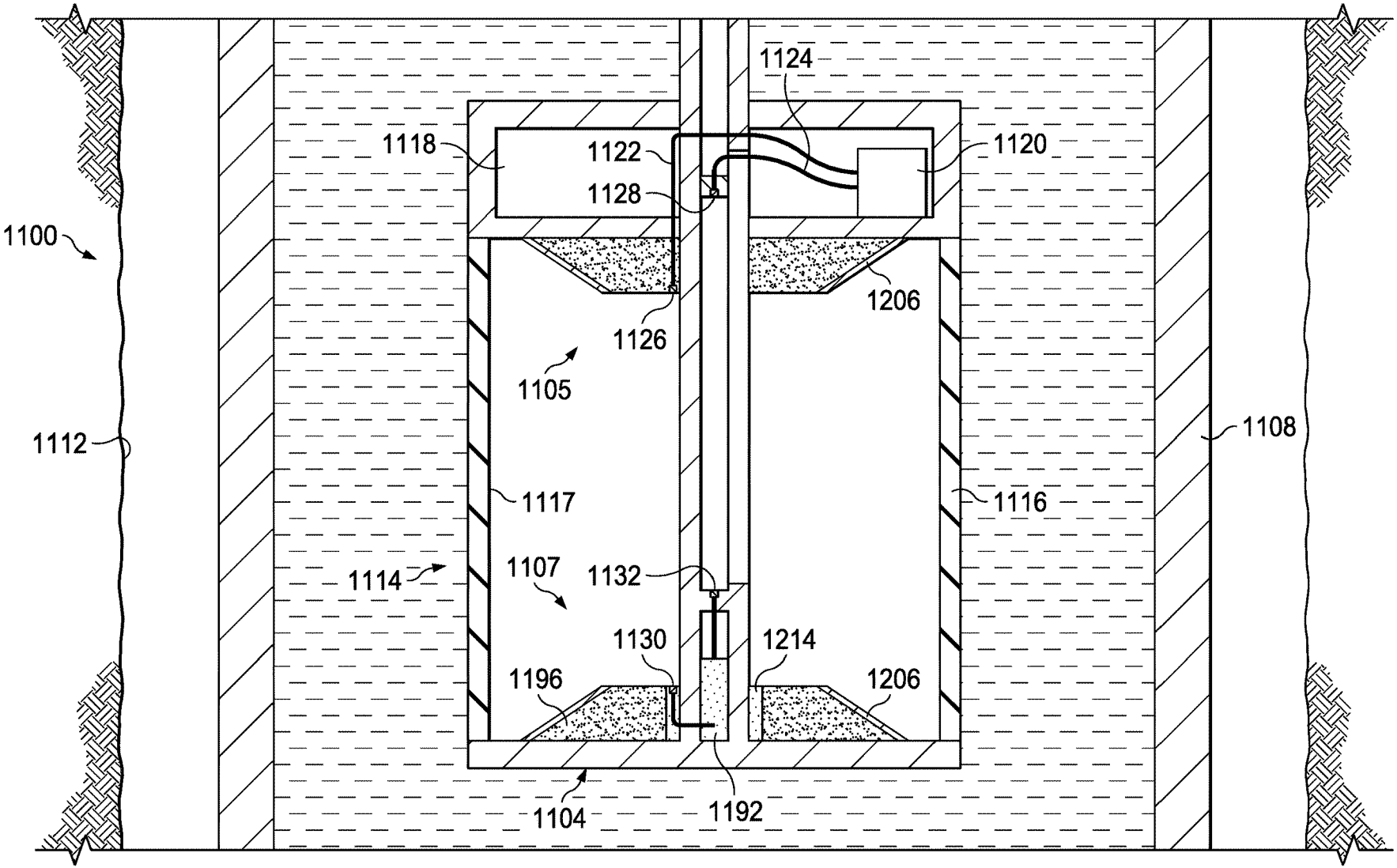
FIG. 11 illustrates a schematic view of a downhole tubular cutting system according to an illustrative embodiment, the cutting system being shown in a pre-initiation stage.

FIG. 11 is a schematic view of a downhole tubular cutting system 1100 according to an embodiment. The downhole tubular cutting system 1100 includes a cutter 1104 separated into a first cutter portion 1105 and a second cutter portion 1107 that is positionable within a tubular 1108 disposed in a wellbore 1112. Similar to the tubulars of FIGS. 1-10, the tubular 1108 may be any type of downhole tubular, but in the illustrated embodiment is a casing. The cutter 1104 includes two halves of an explosive radial shaped-charge cutter, but a cutter of another type may be used as described previously with reference to FIGS. 1-10.

The downhole tubular cutting system 1100 further includes a fluid displacer 1114 which in the illustrated embodiment includes an expandable housing 1116 in which the first cutter portion 1105 and the second cutter portion 1107 of the cutter 1104 are disposed. The expandable housing 1116 includes a flexible wall 1117 that may be made from an elastomeric material. The expandable housing 1116 further includes a fixed chamber 1118 in which is disposed an electrical power source 1120. The electrical power source 1120 is electrically connected by wires 1122 and 1124 to first electrical contacts 1126 and 1128, respectively. The first electrical contacts 1126 and 1128 are disposed at a first end of the expandable housing 1116 and are separated from corresponding second electrical contacts 1130 and 1132 disposed at a second end of the expandable housing 1116. The second electrical contacts 1130 and 1132 are electrically connected to a detonator 1192 that is coupled to a booster 1214, which in turn is coupled to a main charge 1196 associated with the second cutter portion 1107.

The downhole tubular cutting system 1100 is illustrated in FIG. 11 in a pre-initiation stage in which the expandable housing 1116 is in a non-expanded position and the first and second cutter portions 1105, 1107 of the cutter 1104 are separated.

Figure 12:
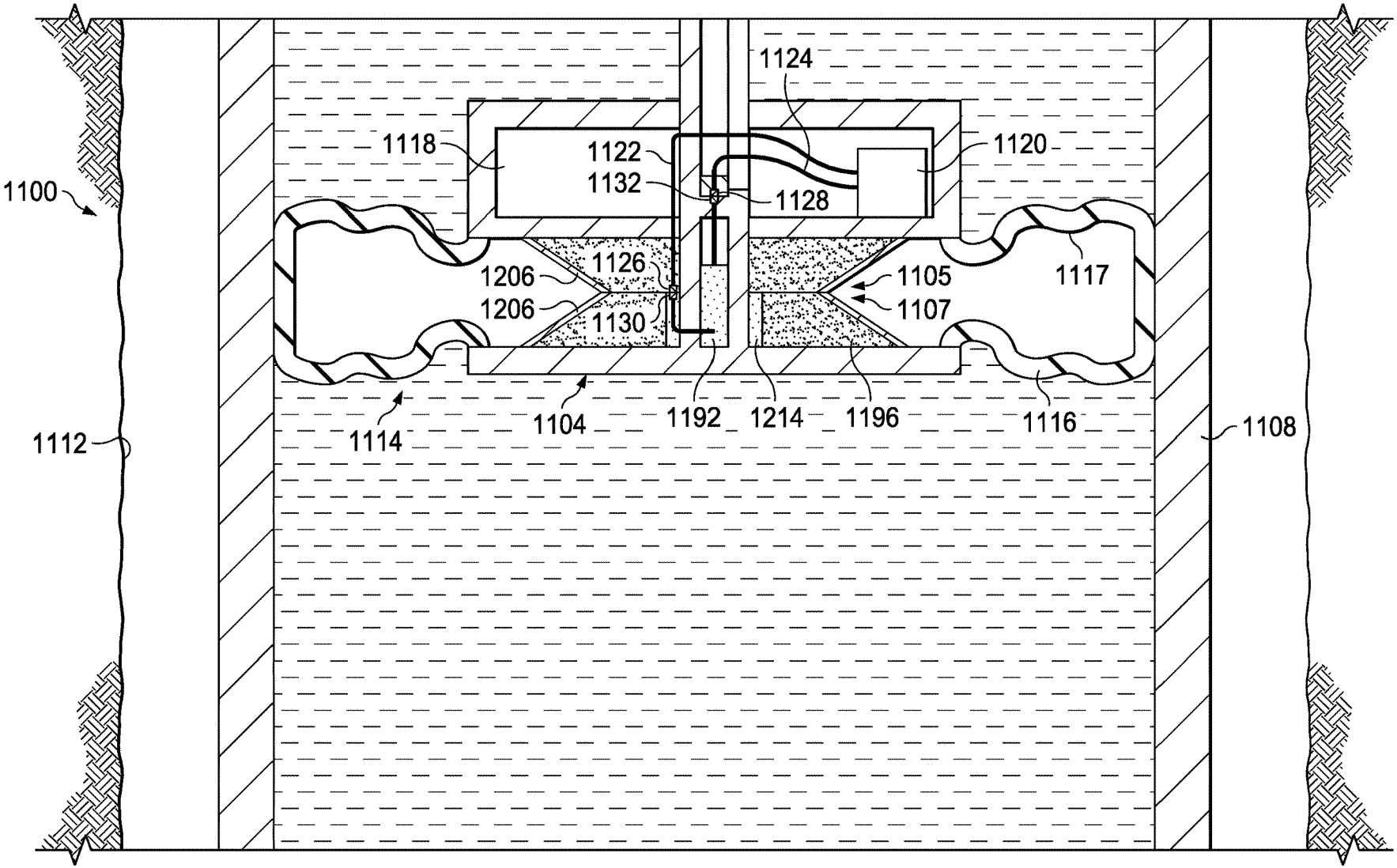
FIG. 12 illustrates a schematic view of the downhole tubular cutting system of FIG. 11, the cutting system being shown in a fluid displacement stage.

FIG. 12 is a schematic view of the downhole tubular cutting system 1100 shown in a fluid displacement stage. In this stage, a setting tool pull rod 1220 connected to a downhole end of the expandable housing 1116 is pulled to expand the expandable housing 1116 into an expanded position. In the expanded position illustrated in FIG. 12, the flexible wall 1117 of the expandable housing 1116 moves radially outward into engagement with the tubular 1108. As the flexible wall 1117 moves outward, the first cutter portion 1105 and the second cutter portion 1107 of the cutter 1104 axially move closer together until the main charge 1196 of each of the cutter portions 1105, 1107 are brought together as shown in FIG. 12. In the expanded position, the expandable housing 1116 displaces wellbore fluid between the cutter 1104 and the tubular 1108. Further, as the expandable housing 1116 reaches the expanded position, the first electrical contacts 1126, 1128 engage the second electric contacts 1130, 1132, which delivers an electrical current from the electrical power source 1120 to the detonator 1192.

Figure 13:
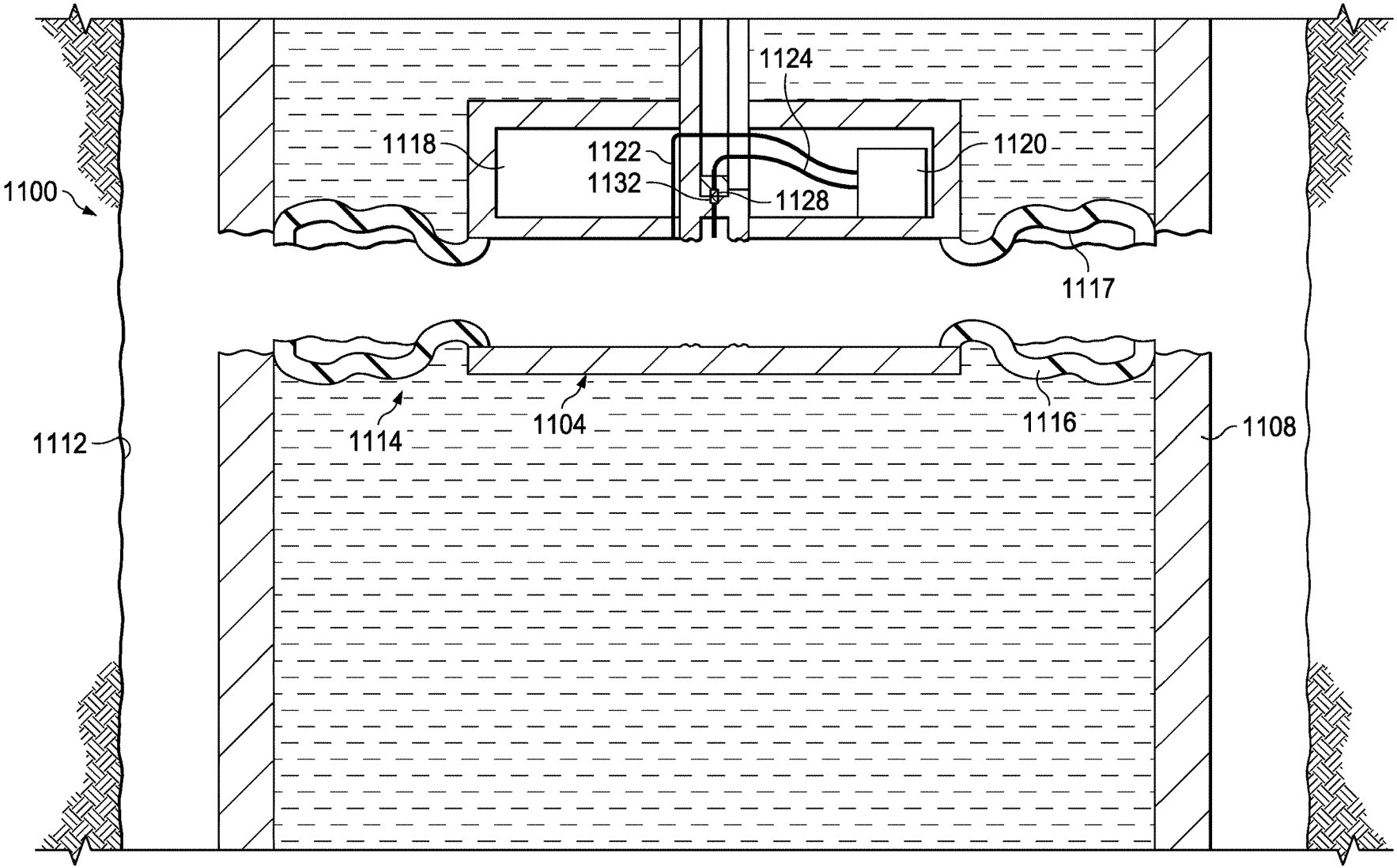
FIG. 13 illustrates a schematic view of the downhole tubular cutting system of FIG. 11, the cutting system being shown in a cutting stage.

FIG. 13 is a schematic view of the downhole tubular cutting system 1100 shown in a cutting stage. Following expansion of the expandable housing 1116 into the expanded position and displacement of the wellbore fluid, the detonator 1192 is initiated when the electrical contacts complete the circuit between the detonator 1192 and the electrical power source 1120. Detonation then moves to the booster 1214 and finally to the main charge 1196. The main charge 1196 explodes at a high rate of speed and force and pushes a liner 1206 radially outward to penetrate and cut the tubular 1108. The displacement of wellbore fluid surrounding the cutter 1104 improves the cutting efficiency of the cutter 1104 as explained previously with reference to the downhole tubular cutting systems 100, 400, and 800 of FIGS. 1-10.

The embodiments of the downhole tubular cutting system described herein, and other embodiments, form the basis for methods of cutting a downhole tubular. The method may include displacing a fluid surrounding a downhole cutter and actuating the cutter to cut the tubular. In an embodiment, displacing a fluid may further comprise generating a gas downhole of the cutter. In another embodiment, the displacement of fluid is accomplished by expanding an airbag surrounding the cutter, which is accomplished by delivering a gas to or generating a gas within the airbag. In yet another embodiment, displacing the fluid may include expanding a housing in which the cutter is housed.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a downhole tubular cutting system comprising: a cutter positionable downhole within a tubular; and a fluid displacer configured to displace fluid from a space between the explosive cutter and the tubular.

Clause 2, the system of clause 1, wherein the fluid displacer is a gas generator.

Clause 3, the system of clause 2, wherein the gas generator further comprises an explosive or combustible material to generate the gas.

Clause 4, the system of clause 2 or 3, wherein the gas generator is configured to generate gas downhole of the cutter.

Clause 5, the system of clause 1, wherein the fluid displacer further comprises an airbag surrounding the cutter and configured to receive a gas that expands the airbag to displace the fluid.

Clause 6, the system of clause 1, wherein the fluid displacer further comprises an expandable housing surrounding the cutter, the expansion of the housing being controllable by a setting rod, the housing in an expanded position displacing the fluid and actuating the detonation of the cutter.

Clause 7, the system of any of clauses 1-6, wherein the space is an annulus formed between the cutter and the tubular.

Clause 8, the system of any of clauses 1-7, wherein the fluid in the space comprises a liquid.

Clause 9, a downhole tubular cutting system comprising: a cutter comprising an explosive material configured to cut a tubular; a generator body coupled to the cutter on an end of the cutter such that the generator body will be oriented uphole or downhole of the cutter when the cutter is positioned with the tubular; and a detonating cord or igniter fuse disposed around the generator body.

Clause 10, the system of clause 9 further comprising a detonator or igniter to detonate or ignite the detonating cord or igniter fuse.

Clause 11, the system of clause 10 further comprising a wire electrically connected to the detonator or igniter to carry a firing signal.

Clause 12, the system of any of clauses 9-11, further comprising a swab cup configured to be positioned uphole of the cutter to capture gas generated by the detonating cord or igniter fuse.

Clause 13, the system of any of clauses 9-12 further comprising: a detonator operably associated with the explosive material of the cutter; wherein the detonating cord or igniter fuse is coupled to a booster operably associated with the detonator; wherein the cutter is configured to fire following completion of detonation or ignition of the detonating cord or igniter fuse.

Clause 14, the system of any of clauses 9-13, wherein the detonating cord or igniter fuse is wrapped in a coiled configuration around the generator body, and the generator body is selectively sized to allow a selected amount of detonating cord or igniter fuse.

Clause 15, the system of clause 14, wherein the selected amount of detonating cord or igniter fuse is based on the pressure of fluid surrounding the cutter.

Clause 16, the system of any of clauses 9-15 further comprising a gas brake coupled to an end of the generator body opposite the cutter, the gas brake having an exposed area about equal to an exposed area of the cutter to prevent axial movement of the cutter during detonation or ignition of the detonating cord or igniter fuse.

Clause 17, a method for cutting a downhole tubular comprising: displacing a fluid surrounding a downhole cutter; and actuating the cutter to cut the tubular.

Clause 18, the method of clause 17, wherein displacing a fluid further comprises generating a gas downhole of the cutter.

Clause 19, the method of clause 17 or 18, wherein displacing a fluid further comprises expanding an airbag surrounding the cutter by delivering a gas to or generating a gas within the airbag.

Clause 20, the method of clause 17 or 18, wherein displacing a fluid further comprises expanding a housing in which the cutter is housed.

While this specification provides specific details related to certain components related to a cutting system and method, it may be appreciated that the list of components is illustrative only and is not intended to be exhaustive or limited to the forms disclosed. Other components related to perforating casings within a wellbore will be apparent to those of ordinary skill in the art without departing from the scope and spirit of the disclosure. Further, the scope of the claims is intended to broadly cover the disclosed components and any such components that are apparent to those of ordinary skill in the art.

It should be apparent from the foregoing disclosure of illustrative embodiments that significant advantages have been provided. The illustrative embodiments are not limited solely to the descriptions and illustrations included herein and are instead capable of various changes and modifications without departing from the spirit of the disclosure.

We claim:

1. A downhole tubular cutting system comprising:

a cutter comprising an explosive material configured to cut a tubular;

a generator body coupled to the cutter on an end of the cutter such that the generator body will be oriented uphole or downhole of the cutter when the cutter is positioned with the tubular; and a detonating cord or igniter fuse disposed around the generator body.

2. The system of claim 1 further comprising a detonator or igniter to detonate or ignite the detonating cord or igniter fuse.

3. The system of claim 2 further comprising a wire electrically connected to the detonator or igniter to carry a firing signal.

4. The system of claim 1, further comprising a swab cup configured to be positioned uphole of the cutter to capture gas generated by the detonating cord or igniter fuse.

5. The system of claim 1 further comprising:

a detonator operably associated with the explosive material of the cutter;

wherein the detonating cord or igniter fuse is coupled to a booster operably associated with the detonator;

wherein the cutter is configured to fire following completion of detonation or ignition of the detonating cord or igniter fuse.

6. The system of claim 1, wherein the detonating cord or igniter fuse is wrapped in a coiled configuration around the generator body, and the generator body is selectively sized to allow a selected amount of detonating cord or igniter fuse.

7. The system of claim 1 further comprising a gas brake coupled to an end of the generator body opposite the cutter, the gas brake having an exposed area about equal to an exposed area of the cutter to prevent axial movement of the cutter during detonation or ignition of the detonating cord or igniter fuse.

8. A method for cutting a downhole tubular comprising:

transmitting a fire signal along a wire to a detonator or igniter that is wrapped around a generator body to detonate or ignite the detonator or igniter;

generating a gas as a result of detonation or ignition of the detonator or igniter that expands around the generator body;

displacing a fluid surrounding a downhole cutter, wherein the fluid is displaced due to an expansion of the gas; and actuating the cutter to cut the tubular.

9. The method of 8, wherein displacing the fluid further comprises generating a gas downhole of the cutter.

10. The method of 8, wherein displacing the fluid further comprises expanding an airbag surrounding the cutter by delivering a gas to or generating a gas within the airbag.

11. The method of 8, wherein displacing the fluid further comprises expanding a housing in which the cutter is housed.

* * * * *